US006411793B1

(12) United States Patent
Badesha et al.

(10) Patent No.: US 6,411,793 B1
(45) Date of Patent: Jun. 25, 2002

(54) TRANSFIX COMPONENT HAVING OUTER LAYER OF HALOELASTOMER WITH PENDANT HYDROCARBON GROUPS

(75) Inventors: Santokh S. Badesha, Pittsford; Edward L. Schlueter, Jr., Rochester, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/788,243

(22) Filed: Feb. 20, 2001

(51) Int. Cl.[7] ..... G03G 15/16; G03G 15/10
(52) U.S. Cl. ..... 399/307; 399/237
(58) Field of Search ..... 399/307, 302, 399/308, 237; 219/216; 428/421; 430/124, 126

(56) References Cited

U.S. PATENT DOCUMENTS 5,537,194 A * 7/1996 Henry et al. ..... 399/308
5,832,352 A * 11/1998 Pan et al. ..... 399/307
6,088,565 A * 7/2000 Jia et al. ..... 399/302

* cited by examiner

*Primary Examiner*—Sophia S. Chen
(74) *Attorney, Agent, or Firm*—Annette L. Bade

(57) ABSTRACT

A transfix member with a substrate, an optional adhesive intermediate layer, and thereover an outer haloelastomer having pendant hydrocarbon chains covalently bonded to a backbone of the haloelastomer, and a heating member associated with the substrate.

20 Claims, 2 Drawing Sheets

TRANSFIX COMPONENT HAVING OUTER LAYER OF HALOELASTOMER WITH PENDANT HYDROCARBON GROUPS

CROSS REFERENCE TO RELATED APPLICATION

Attention is directed to commonly-assigned, copending U.S. patent application Ser. No. 09/698,730, filed Oct. 27, 2000 entitled "TRANSFIX COMPONENT HAVING HALOELASTOMER OUTER LAYER;" U.S. patent application Ser. No. 09/737,413, filed Dec. 14, 2000 entitled, "TRANSFIX COMPONENT HAVING MICA TYPE SILICATE OUTER LAYER;" and U.S. patent application Ser. No. 09/726,756, filed Nov. 29, 2000 entitled, "TRANSFIX COMPONENT HAVING FLUOROSILICONE OUTER LAYER. The disclosures of each of these references are hereby incorporated by reference in their entirety.

BACKGROUND OF THE INVENTION

The present invention relates generally to an imaging apparatus and layers for components thereof, for use in electrostatographic, including digital, apparatuses. The layers herein are useful for many purposes including layers for transfix films or transfuse films, and the like. More specifically, the present invention relates to a transfix or transfuse member comprising a substrate, optional intermediate layer, and an outer layer comprising a haloelastomer having pendant hydrocarbon chains covalently bonded to the backbone of the haloelastomer. The transfix member of the present invention may be used in xerographic machines, especially color machines.

In a typical electrostatographic reproducing apparatus such as an electrophotographic imaging system using a photoreceptor, a light image of an original to be copied is recorded in the form of an electrostatic latent image upon a photosensitive member and the latent image is subsequently rendered visible by the application of a developer mixture. One type of developer used in such printing machines is a liquid developer comprising a liquid carrier having toner particles dispersed therein. Generally, the toner is made up of a resin and a suitable colorant such as a dye or pigment. Conventional charge director compounds may also be present. The liquid developer material is brought into contact with the electrostatic latent image and the colored toner particles are deposited thereon in image configuration.

The developed toner image recorded on the imaging member can be transferred to an image receiving substrate such as paper via an intermediate transfer member. Alternatively, the developed image can be transferred to an intermediate transfer member from the image-receiving member via another transfer member. The toner particles may be transferred by heat and/or pressure to an intermediate transfer member, or more commonly, the toner image particles may be electrostatically transferred to the intermediate transfer member by means of an electrical potential between the imaging member and the intermediate transfer member. After the toner has been transferred to the intermediate transfer member, it can then be transferred to the image receiving substrate, for example by contacting the substrate with the toner image on the intermediate transfer member under heat and/or pressure. Alternatively, the developed image can be transferred to another intermediate transfer member such as a transfix or transfer member. A transfix or transfuse member uses heat associated with the transfer member in order to both transfer and fix or fuse the developed image to a copy substrate.

Intermediate transfer members, including transfix or transfuse members, enable high throughput at modest process speeds. In four-color photocopier systems, the transfer member also improves registration of the final color toner image. In such systems, the four component colors of cyan, yellow, magenta and black may be synchronously developed onto one or more imaging members and transferred in registration onto a transfer member at a transfer station.

In electrostatographic printing machines in which the toner image is transferred from the transfix member to the image receiving or copy substrate, it is important that the transfer of the toner particles from the transfix member to the image receiving substrate be substantially 100 percent. Less than complete transfer to the image receiving substrate results in image degradation and low resolution. Completely efficient transfer is particularly important when the imaging process involves generating full color images since undesirable color deterioration in the final colors can occur when the color images are not completely transferred from the transfer member.

Thus, it is important that the transfix member surface has excellent release characteristics with respect to the toner particles. Conventional materials known in the art for use as transfix members often possess the strength, conformability and electrical conductivity necessary for use as transfix members, but can suffer from poor toner release characteristics, especially with respect to higher gloss image receiving substrates. When heat is associated with a transfer member, such as in the case of a transfix member, the transfix member must also possess good thermal conductivity in addition to superior release characteristics. Also, there is a need for mechanical strength for wear resistance. A transfix member undergoes multiple cycling during use.

In addition, in the event that electrically conductive fillers are needed to build electrical and thermal conductivities, and/or mechanical strength, it is necessary that the fillers be compatible with the materials used in the transfix member. Similarly, if release fluids are used, the materials in the transfix member and the fillers, if used, must be compatible with the release fluid materials. Also, the fillers, if used, and the materials in the transfix members must be chemically compatible with toners or liquid developers used in the electrostatographic apparatus.

U.S. patent application Ser. No. 09/375,592, filed Aug. 17, 1999, now U.S. Pat. No. 6,297,302, discloses a composition comprising a crosslinked product of a liquid composition which comprises (a) a fluorosilicone, (b) a crosslinking agent, and (c) a thermal stabilizing agent comprising a reaction product of (i) a cyclic unsaturated-alkyl-group-substituted polyorganosiloxane, (ii) a linear unsaturated-alkyl-group-substituted polyorganosiloxane, and (iii) a metal acetylacetonate or metal oxalate compound.

U.S. patent application Ser. No. 09/375,974, filed Aug. 17, 1999, discloses a transfer member comprising a crosslinked product of a liquid composition which comprises (a) a fluorosilicone, (b) a crosslinking agent, and (c) a thermal stabilizing agent comprising a reaction product of (i) a cyclic unsaturated-alkyl-group-substituted polyorganosiloxane, (ii) a linear unsaturated-alkyl-group-substituted polyorganosiloxane, and (iii) a metal acetylacetonate or metal oxalate compound, said transfer member having surface a resistivity of from about $10^4$ to about $10^{16}$ ohms/square.

U.S. Pat. No. 5,361,126 discloses an imaging apparatus including a transfer member including a heater and pressure-applying roller, wherein the transfer member includes a fabric substrate and an impurity-absorbent material as a top layer. The impurity-absorbing material can include a rubber elastomer material.

U.S. Pat. No. 5,337,129 discloses an intermediate transfer component comprising a substrate and a ceramer or grafted ceramer coating comprised of integral, interpenetrating networks of haloelastomer, silicon oxide, and optionally polyorganosiloxane.

U.S. Pat. No. 5,340,679 discloses an intermediate transfer component comprised of a substrate and thereover a coating comprised of a volume grafted elastomer, which is a substantially uniform integral interpenetrating network of a hybrid composition of a fluoroelastomer and a polyorganosiloxane.

U.S. Pat. No. 5,480,938 describes a low surface energy material comprising a volume grafted elastomer which is a substantially uniform integral interpenetrating network of a hybrid composition of a fluoroelastomer and a polyorganosiloxane, the volume graft having been formed by dehydrofluorination of fluoroelastomer by a nucleophilic dehydrofluorinating agent, followed by a hydrosilation reaction, addition of a hydrogen functionally terminated polyorganosiloxane and a hydrosilation reaction catalyst U.S. Pat. No. 5,366,772 describes a fuser member comprising a supporting substrate, and a outer layer comprised of an integral interpenetrating hybrid polymeric network comprised of a haloelastomer, a coupling agent, a functional polyorganosiloxane and a crosslinking agent.

U.S. Pat. No. 5,456,987 discloses an intermediate transfer component comprising a substrate and a titamer or grafted titamer coating comprised of integral, interpenetrating networks of haloelastomer, titanium dioxide, and optionally polyorganosiloxane.

U.S. Pat. No. 5,848,327 discloses an electrode member positioned near the donor member used in hybrid scavengeless development, wherein the electrode members have a composite haloelastomer coating.

U.S. Pat. No. 5,576,818 discloses an intermediate toner transfer component including: (a) an electrically conductive substrate; (b) a conformable and electrically resistive layer comprised of a first polymeric material; and (c) a toner release layer comprised of a second polymeric material selected from the group consisting of a fluorosilicone and a substantially uniform integral interpenetrating network of a hybrid composition of a fluoroelastomer and a polyorganosiloxane, wherein the resistive layer is disposed between the substrate and the release layer.

U.S. Pat. No. 6,037,092 discloses a fuser member comprising a substrate and at least one layer thereover, the layer comprising a crosslinked product of a liquid composition which comprises (a) a fluorosilicone, (b) a crosslinking agent, and (c) a thermal stabilizing agent comprising a reaction product of (i) a cyclic unsaturated-alkyl-group-substituted polyorganosiloxane, (ii) a linear unsaturated-alkyl-group-substituted polyorganosiloxane, and (iii) a metal acetylacetonate or metal oxalate compound.

U.S. Pat. No. 5,537,194 discloses an intermediate toner transfer member comprising: (a) a substrate; and (b) an outer layer comprised of a haloelastomer having pendant hydrocarbon chains covalently bonded to the backbone of the haloelastomer.

U.S. Pat. No. 5,753,307 discloses fluoroelastomer surfaces and a method for providing a fluoroelastomer surface on a supporting substrate which includes dissolving a fluoroelastomer; adding a dehydrofluorinating agent; adding an amino silane to form a resulting homogeneous fluoroelastomer solution; and subsequently providing at least one layer of the homogeneous fluoroelastomer solution to the supporting substrate.

U.S. Pat. No. 5,840,796 describes polymer nanocomposites including a mica-type layered silicate and a fluoroelastomer, wherein the nanocomposite has a structure selected from the group consisting of an exfoliated structure and an intercalated structure.

U.S. Pat. No. 5,846,643 describes a fuser member for use in an electrostatographic printing machine, wherein the fuser member has at least one layer of an elastomer composition comprising a silicone elastomer and a mica-type layered silicate, the silicone elastomer and mica-type layered silicate form a delaminated nanocomposite with silicone elastomer inserted among the delaminated layers of the mica-type layered silicate.

Therefore, it is desired to provide a transfix member that possesses the qualities of conformability for copy quality and latitude, and also being tough for wear resistance. It is also desired to provide a transfer member that is electrically conductive to enable electrostatically assisted transfer. It is further desired to provide a transfer member that has low surface energy for release capability, and is chemically resistant to toner ingredients and release agents to enable efficient toner transfer. Preferably, the outer layer is resistant to branched aliphatic hydrocarbons used in liquid development. A further desired characteristic is for a transfer member to have a reduced susceptibility to swelling in the presence of release oils. An additional desired property for a transfix or transfuse member having heat associated therewith, is for the transfix member to be thermally stable for conduction for fusing or fixing.

SUMMARY OF THE INVENTION

The present invention provides, in embodiments, an image forming apparatus for forming images on a recording medium comprising: a) a charge-retentive surface to receive an electrostatic latent image thereon; b) a development component to apply a developer material to the charge-retentive surface to develop the electrostatic latent image to form a developed image on the charge-retentive surface; c) a transfer component for transferring the developed image from the charge-retentive surface to an intermediate transfer component; d) an intermediate transfer component for receiving the developed image from the transfer component and transferring the developed image to a transfix component; and e) a transfix component to transfer the developed image from the intermediate transfer component to a copy substrate and to fix the developed image to the copy substrate, the transfix component comprising: i) a transfix substrate, and having thereon ii) an outer transfix layer comprising a haloelastomer having pendant hydrocarbon chains covalently bonded to a backbone of the haloelastomer, and iii) a heating member associated with the transfix substrate.

Embodiments further include, a transfix member comprising: a) a transfix substrate, and thereover b) a conformable intermediate layer comprising a polymeric material, and having thereon c) an outer transfix layer comprising a haloelastomer having pendant hydrocarbon chains covalently bonded to a backbone of the haloelastomer, and d) a heating member associated with the transfix substrate.

Embodiments also include, an image forming apparatus for forming images on a recording medium comprising: a) a charge-retentive surface to receive an electrostatic latent image thereon; b) a development component to apply a developer material to the charge-retentive surface to develop the electrostatic latent image to form a developed image on the charge-retentive surface; c) a transfer component for transferring the developed image from the charge-retentive surface to an intermediate transfer component; d) an intermediate transfer component for receiving the developed image from the transfer component and transferring the developed image to a transfix component; and e) a transfix component to transfer the developed image from said intermediate transfer component to a copy substrate and to fix the developed image to the copy substrate, the transfix component comprising i) a transfix substrate comprising a material selected from the group consisting of metal and fabric, and thereover ii) an adhesive intermediate layer, and having thereon iii) an outer transfix layer comprising a haloelastomer having pendant hydrocarbon chains covalently bonded to a backbone of the haloelastomer, and iv) a heating member associated with the transfix substrate.

BRIEF DESCRIPTION OF THE DRAWINGS

The above embodiments of the present invention will become apparent as the following description proceeds upon reference to the drawings, which include the following figures.

DETAILED DESCRIPTION OF THE INVENTION

The present invention is directed to transfix members having layers. The transfix members can be film components including films, sheets, belts and the like, useful in electrostatographic, including digital, apparatuses. In one embodiment of the present invention, a transfix member comprises a substrate, an optional intermediate adhesive layer, and an outer layer comprising a haloelastomer having pendant hydrocarbon chains covalently bonded to the backbone of the haloelastomer. In particularly preferred embodiments, the transfix substrate may comprise optional electrically conductive fillers and fibers to achieve optimum electrical field and thermal transfer. Combinations of these fillers may also be used.

Figure 1:
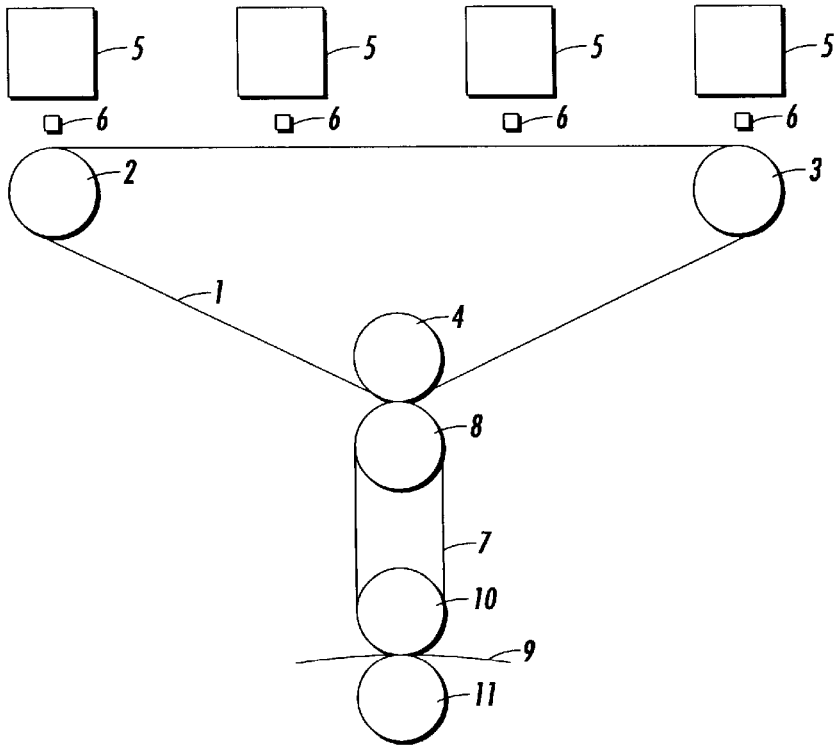
FIG. 1 is an illustration of a general electrostatographic apparatus using a transfix member.

Referring to FIG. 1, there is depicted an image-forming apparatus comprising intermediate transfer member 1 advanced by rollers 2, 3 and 4. Intermediate transfer member 1 is depicted as a belt or film member, but may be of another useful form such as a belt, sheet, film, drum, roller or the like. An image is processed and developed by image processing units 5. There may be as few as 1 processing unit, for example, for 1 color processing such as black, and as many processing units as desired. In embodiments, each processing unit processes a specific color. In preferred embodiments, there are 4 processing units for processing cyan, black, yellow and magenta. The first processing unit processes one color and transfers this developed one-color image to the intermediate transfer member 1 via transfer member 6. The intermediate transfer member 1 is advanced to the next relevant processing unit 5 and the process is repeated until a fully developed image is present on the intermediate transfer member 1.

After the necessary number of images are developed by image processing members 5 and transferred to intermediate transfer member 1 via transfer members 6, the fully developed image is transferred to transfix member 7. The transfer of the developed image to transfix member 7 is assisted by rollers 4 and 8, either or both of which may be a pressure roller or a roller having heat associated therewith. In a preferred embodiment, one of 4 roller or 8 roller is a pressure member, wherein the other roller 4 or 8 is a heated roller. Heat may be applied internal or external to the roller. Heat may be supplied by any known heat source.

In a preferred embodiment, the fully developed image is subsequently transferred to a copy substrate 9 from transfix member 7. Copy substrate 9, such as paper, is passed between rollers 10 and 11, wherein the developed image is transferred and fused to the copy substrate by transfix member 7 via rollers 10 and 11. Rollers 10 and/or 11 may or may not contain heat associated therewith. In a preferred embodiment, one of rollers 10 and 11 contains heat associated therewith in order to transfer and fuser the developed image to the copy substrate. Any form of known heat source may be associated with roller 10 and/or 11.

Figure 2:
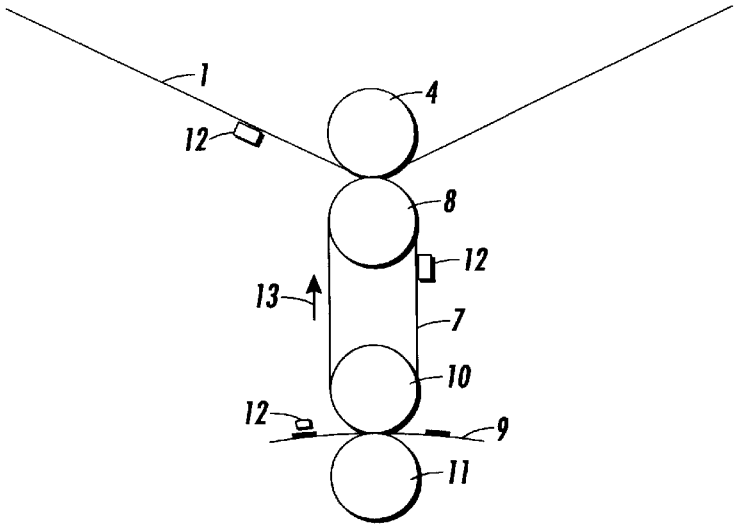
FIG. 2 is an enlarged view of an embodiment of a transfix system.

FIG. 2 demonstrates an enlarged view of a preferred embodiment of a transfix member 7 which may be in the form of a belt, sheet, film, roller, or like form. The developed image 12 positioned on intermediate transfer member 1, is brought into contact with and transferred to transfix member 7 via rollers 4 and 8. As set forth above, roller 4 and/or roller 8 may or may not have heat associated therewith. Transfix member 7 proceeds in the direction of arrow 13. The developed image is transferred and fused to a copy substrate 9 as copy substrate 9 is advanced between rollers 10 and 11. Rollers 10 and/or 11 may or may not have heat associated therewith.

Figure 3:
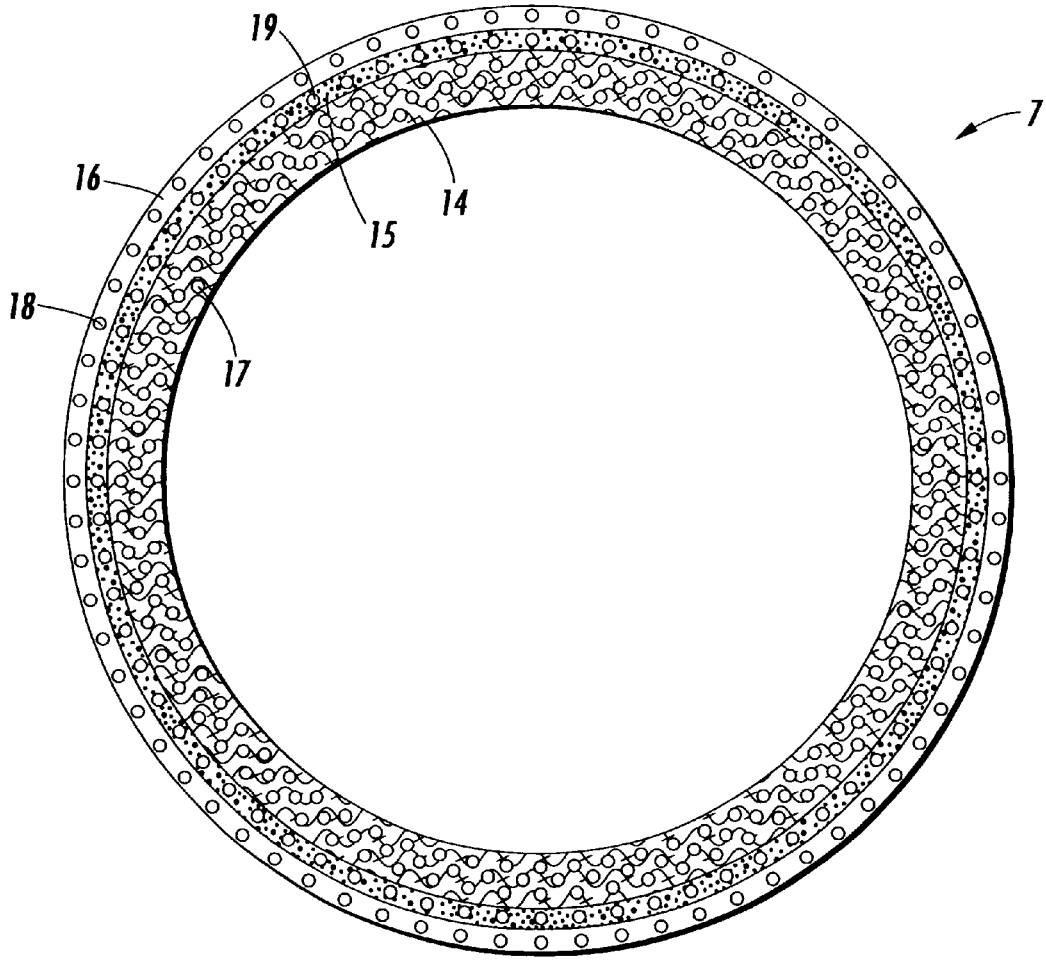
FIG. 3 is an enlarged view of a preferred embodiment of a transfix belt configuration involving a substrate, an adhesive intermediate layer, and thin outer layer.

FIG. 3 demonstrates a preferred embodiment of the invention, wherein transfix member 7 comprises substrate 14, having thereover adhesive intermediate layer 15. Outer layer 16 is positioned on the intermediate layer 15. In a preferred embodiment, the outer layer may comprise electrically conductive fillers 18. Substrate 14, in preferred embodiments, comprises metal or fabric. Substrate 14 may contain electrically conductive fillers 17 dispersed or contained therein. The intermediate adhesive layer may also have electrically conductive fillers 19 dispersed or contained therein. In a preferred embodiment, the substrate comprises a fabric material, the intermediate layer 15 is an adhesive layer, and the outer layer 16 is a thin haloelastomer overcoat.

The transfix outer layer(s) herein comprise an outer release layer comprising a haloelastomer having hydrocarbon chains covalently bonded to the backbone of the haloelastomer.

The present haloelastomer configuration differs from known configurations in that the hydrocarbon chains are appended to the backbone of the haloelastomer, in contrast to known chains which are an integral part of the backbone such as random or block copolymers comprising hydrocarbon segments and haloelastomer segments. Accordingly, the hydrocarbon chains are referred to herein as being pendant hydrocarbon chains.

The hydrocarbon chains may be either dispersed or contained in the outer surface layer of the outer transfix layer, preferably in a uniform manner. Also, it is preferred that the hydrocarbon chains be present over the entire surface layer of the outer transfix layer. Preferably, the hydrocarbon chains are dispersed or contained in an amount of from about 75 to about 100, and preferably from about 95 to about 100 percent of the outer surface layer of the outer transfix layer.

As used herein, the phrase "surface graft" refers to the presence of the pendant hydrocarbon chains at the surface of the outer layer to a depth less than the entire thickness of the outer layer. The depth of the surface graft ranges, for example, from about 100 to about 250 angstroms, and preferably from about 150 to about 200 angstroms. As used herein, the term "volume graft" refers to the presence of the pendant hydrocarbon chains in the entire thickness of the outer layer.

The hydrocarbon chains can be covalently bonded to the haloelastomer by any suitable known method. For example, the hydrocarbon chains may have one or more functional end groups. The general reaction mechanism can involve the dehydrohalogenation of the haloelastomer, thereby creating double bond sites, with subsequent nucleophilic insertion of the functional end groups of the hydrocarbon chains at the double bond sites. In the surface graft case, cured or uncured haloelastomer films or coatings can be surface treated with a grafting agent which may be, for example, an amino terminated hydrocarbon chain such as hexadecylamine. The amino functionality may be a primary, secondary, or tertiary amine as described herein. The main reaction is as stated above involving dehydrohalogenation followed by the nucleophilic attack of the amino functionality to the reactive sites. These reactive sites are carbon-carbon double bonds. As a result, the graft is on the surface of the transfix member.

The dehydrohalogenating agent, which attacks the haloelastomer generating unsaturation, is selected from the group of strong nucleophilic agents such as peroxides, hydrides, bases, oxides, and the like. The preferred agents are selected from the group consisting of primary, secondary and tertiary, aliphatic and aromatic amines, where the aliphatic and aromatic groups have from 2 to 15 carbon atoms. It also includes aliphatic and aromatic diamines and triamines having from 2 to 15 carbon atoms where the aromatic groups may be benzene, toluene, naphthalene, anthracene, or the like. It is generally preferred for the aromatic diamines and triamines that the aromatic group be substituted in the ortho, meta and para positions. Typical substituents include lower alkylamino groups such as ethylamino, propylamino and butylamino with propylamino being preferred. Specific amine dehydrohalogenating agents include N-(2-aminoethyl-3-aminopropyl)trimethoxy silane, 3-(N-strylmethyl-2-aminoethylamino)propyltrimethoxy silane hydrochloride and (aminoethylamino methyl) phenethyltrimethoxy silane.

Conversely, a volume graft is made in solution. To prepare a volume graft, the basic steps are the same, and include dehydrohalogenation followed by nucleophilic attack which results in the formation of the covalent bonds between the haloelastomer and the amino terminated hydrocarbon chain. The volume graft solution is then cured.

Suitable haloelastomers for use herein include any suitable halogen containing elastomer such as chloroelastomers, bromoelastomers, fluoroelastomers, or mixtures thereof. Fluoroelastomer examples include those described in detail in Lentz, U.S. Pat. No. 4,257,699, as well as those described in Eddy et al., U.S. Pat. No. 5,017,432 and Ferguson et al., U.S. Pat. No. 5,061,965. The disclosures of each of these patents are totally incorporated herein by reference. As described therein, these fluoroelastomers include copolymers and terpolymers of vinylidenefluoride, hexafluoropropylene and tetrafluoroethylene, which are known commercially under various designations as VITON A®, VITON E®, VITON E60C®, VITON E45®, VITON E430®, VITON B910®, VITON GH®, VITON B50®, VITON E45®, and VITON GF®. The VITON® designation is a Trademark of E.I. DuPont de Nemours, Inc. Two preferred known fluoroelastomers are (1) a class of copolymers of vinylidenefluoride, hexafluoropropylene and tetrafluoroethylene, (such as a copolymer of vinylidenefluoride and hexafluoropropylene) known commercially as VITON A®, (2) a class of terpolymers of vinylidenefluoride, hexafluoropropylene and tetrafluoroethylene known commercially as VITON B®, and (3) a class of tetrapolymers of vinylidenefluoride, hexafluoropropylene, tetrafluoroethylene and a cure site monomer. The cure site monomer can be those available from DuPont such as 4-bromoperfluorobutene-1,1,1-dihydro-4-bromoperfluorobutene-1, 3-bromoperfluoropropene- 1,1,1-dihydro-3-bromoperfluoropropene-1, or any other suitable, known, commercially available cure site monomer.

In another preferred embodiment, the fluoroelastomer is a tetrapolymer having a relatively low quantity of vinylidenefluoride. An example is VITON GF®, available from E.I. DuPont de Nemours, Inc. The VITON GF® has 35 weight percent of vinylidenefluoride, 34 weight percent of hexafluoropropylene and 29 weight percent of tetrafluoroethylene with 2 weight percent cure site monomer.

Typically, these fluoroelastomers are cured with a nucleophilic addition curing system, such as a bisphenol crosslinking agent with an organophosphonium salt accelerator as described in further detail in the above-referenced Lentz patent and in U.S. Pat. No. 5,017,432. The fluoroelastomer is generally cured with bisphenol phosphonium salt, or a conventional aliphatic peroxide curing agent.

It is believed that some of the aforementioned haloelastomers and others that can be selected include VITON E45®, AFLAS®, FLUOREL® I, FLUOREL® II, TECHNOFLON® and the like commercially-available haloelastomers.

Unless otherwise indicated, the discussion herein of the hydrocarbon chains refers to the unreacted form. Each of the hydrocarbon chains (excluding any carbon atoms which may be in the functional groups) has, for example, from about 6 to about 14 carbon atoms, and preferably from about 8 to about 12 carbon atoms. The hydrocarbon chains are preferably saturated such as alkanes like hexane, heptane, decane, and the like. Each hydrocarbon chain may have one, two, or more functional groups, a functional group coupled to, for instance, an end carbon atom, to facilitate covalent bonding of the hydrocarbon chain to the backbone of the haloelastomer. It is preferred that each hydrocarbon chain has only one functional end group. The functional group or groups may be for instance —OH, —$NH_2$, —NRH, —SH, —$NHCO_2$, where R is hydrogen or a lower alkyl having, for example, from about 1 to about 4 carbon atoms. The hydrocarbon chains bonded to the haloelastomer can be similar or identical to the carrier fluids conventionally employed in liquid developers. It is preferred that from about 85 to about 100 percent of the hydrocarbon chains are saturated, and particularly preferred, from about 95 to about 100 percent.

The outer layer preferably has a thickness ranging, for example, from about 0.1 to about 10 mils, preferably from about 0.2 to about 5 mils, and more preferably from about 1 to about 3 mils.

The layers, including the substrate and/or the outer release layer, in embodiments, may comprise electrically conductive particles dispersed therein. These electrical conductive particles decrease the material resistivity into the desired resistivity range. The desired surface resistivity is from about $10^6$ to about $10^{14}$, preferably from about $10^9$ to about $10^{13}$, and more preferably from about $10^{10}$ to about $10^{12}$ ohms/sq. The preferred volume resistivity range is from about $10^{5}$ to about $10^{14}$, preferably from about $10^{8}$ to about $10^{14}$, and particularly preferred is from about $10^{10}$ to about $10^{12}$ ohm-cm. The desired resistivity can be provided by varying the concentration of the conductive filler. It is important to have the resistivity within this desired range. The transfix components may exhibit undesirable effects if the resistivity is not within the required range. Other problems include resistivity that is susceptible to changes in temperature, relative humidity, and the like.

Fillers are added to the surface coating to achieve the proper electrical and thermal properties without adversely effecting the release properties with high surface area fillers. Examples of conductive fillers for use in the outer layer, include conventional electrically conductive fillers such as metals, metal oxides, carbon blacks, and conductive polymers such as polyanaline, polypyrroles, polythiophenes, and the like, and mixtures thereof. In a preferred embodiment of the invention, the electrically conductive filler is carbon black and/or antimony tin oxide. The optional conductive filler is present in the layer in an amount of from about 1 to about 40 percent, preferably from about 2 to about 30 percent by weight of total solids in the layer. Total solids, as used herein, refers to the amount of solid material, such as fillers, adjuvants, polymers and like solid materials, in the referenced layer.

Other adjuvants and fillers may be incorporated in the outer layer in embodiments of the present invention provided they do not adversely affect the integrity of the outer layer. Such fillers may include coloring agents, reinforcing fillers, crosslinking agents, processing aids, accelerators and polymerization initiators. Adjuvants and fillers may be present in the outer layer in an amount ranging, for example, from about 5 to about 30 percent, preferably from about 10 to about 15 percent by weight based on the weight of the outer layer.

There may be an adhesive intermediate layer between the outer layer and the substrate. If the adhesive is being used as an interlayer adhesive the preferred thickness is from about 0.1 to about 0.5 mils. If the adhesive layer is also being used as the comformable intermediate layer than the preferred range is from about 3 to about 5 mils. The thickness of the adhesive is also dependent on the electrical and thermal properties of the adhesive Examples of adhesives include epoxy resins, and the like. Examples of suitable commercially available adhesives include THIOXON® 403/404 and THIOXON® 330/301 both available from Morton International of Ohio; GE -2872-074 available from the General Electric Company which is believed to be a copolymer of polyimide and siloxane; a silane coupling agent such as Union Carbide A-1100 which is an amino functional siloxane; epoxy resins including bisphenol A epoxy resins available, for example, from Dow Chemical Company such as Dow TACTIX® 740, Dow TACTIX® 741, and Dow TACTIX® 742, and the like, optionally with a crosslinker or curative such as Dow® H41 available from the Dow Chemical Company.

By covalently bonding hydrocarbon chains to the haloelastomer in the outer layer, a surface is created which is compatible with the toner, and preferably with the suitable liquid developer. Moreover, the outer layer does not chemically react with the components of the toner or liquid developer.

In the liquid development process it is desirable that the outer layer of the transfix member swells slightly with liquid ink. The desired swell is anywhere from about 2 to about 10 percent by volume. More than this level of swell adversely impacts the physical properties of the transfer member. The reason for the need for this relatively small amount of swell is so that the image will not adhere to the surface of the outer layer of the transfix member and therefore the image will be transferred and fixed or fused without offset. The surface graft allows the very top surface to swell with the ink to levels close to about 5 percent by volume, all other desired properties including electrical and mechanical properties of the transfix member have minimum effect. This level of swell enables approximately 100 percent toner transfer efficiency. To the contrary, a fluoroelastomer (for example, those sold under the tradename VITON® from DuPont) transfix member without the surface graft will have a toner offset problem where the toner transfer efficiency is less than 100 percent.

In the case of liquid development, a liquid carrier medium is present in a relatively large amount in the developer composition. The liquid medium is usually present in an amount of from about 80 to about 98 percent by weight, although this amount may vary from this range provided that the objectives of the present invention are achieved. By way of example, the liquid carrier medium may be selected from a wide variety of materials, including, but not limited to, any of several hydrocarbon liquids conventionally employed for liquid development processes. These include high purity alkanes having from about 6 to about 14 carbon atoms, such as Norpar® 12, Norpar® 13, and Norpar® 15, and isoparaffinic hydrocarbons such as Isopar® G, H, L, and M, available from Exxon Corporation. Other examples of materials suitable for use as a liquid carrier include Amsco® 460 Solvent and Amsco® OMS available from American Mineral Spirits Company, Soltrol® available from Phillips Petroleum Company, Pagasol® available from Mobil Oil Corporation, Shellsol® available from Shell Oil Company, and the like. Isoparaffinic hydrocarbons provide a preferred liquid media, since they are colorless, environmentally safe, and possess a sufficiently high vapor pressure so that a thin film of the liquid evaporates from the contacting surface within seconds at ambient temperatures.

The substrate can comprise any material having suitable strength and flexibility for use as a transfix member, enabling the member to cycle around rollers during continuous use of the machine. Preferred materials for the substrate include metals, rubbers and fabrics. Preferred metals include steel, aluminum, nickel, and their alloys, and like metals and alloys of like metals. Examples of suitable rubbers include ethylene propylene dienes, silicone rubbers, fluoroelastomers, n-butyl rubbers and the like.

A fabric material, as used herein, refers to a textile structure comprised of mechanically interlocked fibers or filaments, which may be woven or nonwoven. Fabrics are materials made from fibers or threads and woven, knitted or pressed into a cloth or felt type structures. Woven, as used herein, refers to closely oriented by warp and filler strands at right angles to each other. Nonwoven, as used herein, refers to randomly integrated fibers or filaments. The fabric material should have high mechanical strength and possess electrical and thermal properties that enable the transfix member to perform the transfix function without degradation of release or toner transfer with repeated cycling.

Examples of suitable fabrics include woven or nonwoven cotton fabric, graphite fabric, fiberglass, woven or nonwoven polyimide (for example KELVAR® available from DuPont), woven or nonwoven polyamide, such as nylon or polyphenylene isophthalamide (for example, NOMEX® of E.I. DuPont of Wilmington, Del.), polyester, aramids, polycarbonate, polyacryl, polystyrene, polyethylene, polypropylene, cellulose, polysulfone, polyxylene, polyacetal, and the like, and mixtures thereof.

Preferably, the substrate is of a thickness of from about 1 to about 65 mils, and preferably from about 40 to about 60 mils.

The substrate may comprise an optional electrically conductive filler. Suitable fillers include metals, metal oxides, doped metal oxides, polymer fillers, carbon blacks, and mixtures thereof. Preferably, the substrate comprises fillers such as carbon black, antimony tin oxide or mixtures thereof. The filler may be present in the substrate in an amount of from about 5 to about 40 percent, and preferably from about 10 to about 20 percent by weight of total solids.

Examples of suitable transfix members include a sheet, a film, a web, a foil, a strip, a coil, a cylinder, a drum, an endless strip, a circular disc, a belt including an endless belt, an endless seamed flexible belt, an endless seamless flexible belt, an endless belt having a puzzle cut seam, and the like. It is preferred that the substrate having the outer layer thereon, be an endless seamed flexible belt or seamed flexible belt, which may or may not include puzzle cut seams.

The transfix film, preferably in the form of a belt, has a width, for example, of from about 150 to about 2,000 mm, preferably from about 250 to about 1,400 mm, and particularly preferred is from about 300 to about 500 mm. The circumference of the belt is preferably from about 75 to about 2,500 mm, more preferably from about 125 to about 2,100 mm, and particularly preferred from about 155 to about 550 mm.

Specific embodiments of the invention will now be described in detail. These examples are intended to be illustrative, and the invention is not limited to the materials, conditions, or process parameters set forth in these embodiments. All parts are percentages by weight of total solids as defined above unless otherwise indicated.

EXAMPLES

Example 1

Preparation of a Transfix Belt from Haloelastomer having Pendant Hydrocarbon Chains as Outer Layer A dispersion comprising two parts was prepared as follows. Part A was prepared by adding 100 parts by weight VITON® GF obtained from DuPont Co., 25 parts by weight of Regal 250 carbon black obtained from Cabot Chemical Co., 15 parts by weight MAGLITE® YTM (MgO) in methyl ethyl ketone ("MIBK") to a 15 percent solids mixture. Part B was prepared by adding 5 parts of VITON® Curative VC50 to 28.3 parts of MIBK. Part B was added to part A and roll milled for 45 minutes. The resulting dispersion was dried at ambient conditions for about 24 hours, and subsequently step cured for 2 hours at 65° C., 4 hours at 77° C., 2 hours at 177° C., and finally 14 hours at 220° C., The resulting dry thickness of the outer layer was 4 mils.

A surface graft of 1-hexadecylamine was prepared as follows. The belt was soaked for about 2 hours in a 20 percent solution of 1-hexadecylamine available from Aldrich Chemical Co., in hexane. The belt was taken out of the bath, air dried for 5 hours, and heated in an oven for 2 hours which was maintained at about 102° C.

Example 2

Preparation of Transfix Belts

The belt prepared in Example 1 could be incorporated into a two belt, liquid development, transfuse fixture. The belt temperature can be maintained at about 120° C. It is estimated that from about 97 to about 98 percent of the developer will be transferred from this belt to the paper. On repeated cycling, the toner transfer efficiency is expected to not degrade indicating that this belt could have extended release life for a viable product.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

We claim:

1. An image forming apparatus for forming images on a recording medium comprising:

a) a charge-retentive surface to receive an electrostatic latent image thereon;

b) a development component to apply a developer material to said charge-retentive surface to develop said electrostatic latent image to form a developed image on said charge-retentive surface;

c) a transfer component for transferring said developed image from said charge-retentive surface to an intermediate transfer component;

d) said intermediate transfer component receives said developed image from said transfer component and transfers said developed image to a transfix component; and e) said transfix component transfers the developed image from said intermediate transfer component to a copy substrate and fixes said developed image to said copy substrate, said transfix component comprising:

i) a transfix substrate, having thereon ii) an outer transfix layer comprising a haloelastomer having pendant hydrocarbon chains covalently bonded to a backbone of the haloelastomer, and iii) a heating member associated with said transfix substrate.

2. An image-forming apparatus in accordance with claim 1, wherein each of said hydrocarbon chains has from about 6 to about 14 carbon atoms.

3. An image-forming apparatus in accordance with claim 2, wherein each of said hydrocarbon chains has from about 8 to about 12 carbon atoms.

4. An image-forming apparatus in accordance with claim 1, wherein from about 85 to about 100 percent of the hydrocarbon chains are saturated.

5. An image-forming apparatus in accordance with claim 4, wherein from about 95 to about 100 percent of the hydrocarbon chains are saturated.

6. An image-forming apparatus in accordance with claim 1, wherein said haloelastomer is a fluoroelastomer.

7. An image-forming apparatus in accordance with claim 6, wherein said fluoroelastomer is selected from the group consisting of a) copolymers of vinylidene fluoride, hexafluoropropylene and tetrafluoroethylene, b) terpolymers of vinylidene fluoride, hexafluoropropylene and tetrafluoroethylene, and c) tetrapolymers of vinylidene fluoride, hexafluoropropylene, tetrafluoroethylene and a cure site monomer.

8. An image-forming apparatus in accordance with claim 1, wherein an intermediate adhesive layer is positioned between said transfix substrate and said outer transfix layer.

9. An image-forming apparatus in accordance with claim 8, wherein said adhesive layer comprises an epoxy resin.

10. An image-forming apparatus in accordance with claim 1, wherein said outer transfix layer further comprises a conductive filler dispersed therein.

11. An image-forming apparatus in accordance with claim 10, wherein said conductive filler is selected from the group consisting of metals, metal oxides, carbon blacks, polymers and mixtures thereof.

12. An image forming apparatus in accordance with claim 1, wherein said transfix substrate comprises a metal.

13. An image forming apparatus in accordance with claim 1, wherein said transfix substrate comprises a fabric material.

14. An image forming apparatus in accordance with claim 13, wherein said fabric material is selected from the group consisting of nonwoven cotton fabric, graphite fabric, fiberglass, woven polyimide, nonwoven polyimide, woven polyamide, nonwoven polyamide, polyester, aramids, polycarbonate, polyacryl, polystyrene, polyethylene, polypropylene, cellulose, polysulfone, polyxylene, polyacetal, and mixtures thereof.

15. An image-forming apparatus in accordance with claim 1, wherein said hydrocarbon chains are located in a surface portion of said transfix outer layer.

16. An image-forming apparatus in accordance with claim 15, wherein said hydrocarbon chains are present in from about 75 to about 100 percent of the surface of said outer transfix layer.

17. An image-forming apparatus in accordance with claim 16, wherein said hydrocarbon chains are present in from about 95 to about 100 percent of the surface of said outer transfix layer.

18. An image-forming apparatus in accordance with claim 1, wherein said developer material is a liquid developer material.

19. A transfix member comprising:

a) a transfix substrate, and thereover b) an adhesive intermediate layer, and having thereon c) an outer transfix layer comprising a haloelastomer having pendant hydrocarbon chains covalently bonded to a backbone of the haloelastomer, and d) a heating member associated with said transfix substrate.

20. An image forming apparatus for forming images on a recording medium comprising:

a) a charge-retentive surface to receive an electrostatic latent image therein;

b) a development component to apply a developer material to said charge-retentive surface to develop said electrostatic latent image to form a developed image on said charge-retentive surface;

c) a transfer component for transferring said developed image from said charge-retentive surface to an intermediate transfer component;

d) said intermediate transfer component receives said developed image from said transfer component and transfers said developed image to a transfix component;and e) said transfix component transfers the developed image from said intermediate transfer component to a copy substrate and fixes said developed image to said copy substrate, said transfix component comprising:

i) a transfix substrate comprising a material selected from the group consisting of metal and fabric, and thereover ii) an adhesive intermediate layer, and having thereon iii) an outer transfix layer comprising a haloelastomer having pendant hydrocarbon chains covalently bonded to a backbone of the haloelastomer, and iv) a heating member associated with said transfix substrate.

* * * * *